US005761597A

United States Patent [19]

Smith et al.

[11] Patent Number: 5,761,597

[45] Date of Patent: Jun. 2, 1998

[54] FUSING APPARATUS FOR A PRINTER

[75] Inventors: Craig Smith, Portland; H. Erwin Grellmann, Aloha; Leonard Guan, Wilsonville; David D. Martenson, Milwaukie, all of Oreg.

[73] Assignee: Tektronix, Inc., Wilsonville, Oreg.

[21] Appl. No.: 713,637

[22] Filed: Sep. 12, 1996

[51] Int. Cl.[6] ..... G03G 15/00; G03G 15/20; G03G 21/00

[52] U.S. Cl. ..... 399/339; 399/324; 430/98

[58] Field of Search ..... 399/339, 331, 399/324; 100/156, 210; 101/424.2; 430/98; 347/102

[56] References Cited

U.S. PATENT DOCUMENTS

| | | | |
|---|---|---|---|
| 3,293,059 | 12/1966 | Stowell | 117/17.5 |
| 3,566,076 | 2/1971 | Fantuzzo | 219/216 |
| 4,010,834 | 3/1977 | Linder | 197/1 |
| 4,305,330 | 12/1981 | Ogihara . | |
| 4,356,764 | 11/1982 | Haugen | 100/169 |
| 4,363,862 | 12/1982 | Giorgini | 430/98 |
| 4,568,949 | 2/1986 | Muranaka | 346/76 |
| 4,745,420 | 5/1988 | Gerstenmaier | 346/140 |
| 4,768,050 | 8/1988 | Beery | 354/304 |
| 4,845,519 | 7/1989 | Fuse | 346/153 |
| 4,889,761 | 12/1989 | Titterington et al. | 428/195 |
| 5,092,235 | 3/1992 | Rise | 100/168 |
| 5,195,430 | 3/1993 | Rise | 100/168 |
| 5,285,248 | 2/1994 | Menjo et al. . | |

*Primary Examiner*—R. L. Moses
*Attorney, Agent, or Firm*—Ralph D'Alessandro

[57] ABSTRACT

An improved fusing apparatus for fixing or fusing images on print media is disclosed wherein a relatively small pressure applying surface, such as the surface of a rotatable pressure wheel, is lubricated with a lubricating medium such as silicone oil, and engages the printed image to apply pressure and fuse the image to the image receiving substrate. The fusing apparatus is mounted for reciprocal back and forth movement across the printed image on the image receiving substrate or medium to fuse the image into the substrate and flatten or smooth the upper exposed surface of the ink image. The pressure wheel is passed in multiple overlapping passes over the printed image to uniformly fuse the image into the media.

7 Claims, 4 Drawing Sheets

FUSING APPARATUS FOR A PRINTER

FIELD OF INVENTION

This invention relates generally to printing and more particularly to a pressure fusing or fixing apparatus in which a printed image on a sheet of medium is subjected to pressure and fused to the medium by a fusing roller or wheel.

BACKGROUND OF THE INVENTION

It is well known in printers to pass sheets of media on which an image is to be fixed or developed through a high pressure nip. This process, known as fusing, permits the image to be fixedly fused to the image-receiving medium to ensure durability and a high quality image. Where solid or phase change ink is employed, the fusing process also serves to flatten or smooth the upper surface of the printed image to obtain a high quality image.

Where a high pressure nip is employed, the nip can be defined by a pair of rollers. Commonly, the journaled ends of the rollers are loaded with a force applied in a direction normal to the axis of the rollers and in a direction which biases the rollers together to form the nip. Application of a load in this manner results in bending moments in the loaded rollers. The bending moments cause the rollers to deflect or bow in the center such that there is a reduced or minimum fixing or developing pressure at the center of the nip. This deflection at the center of the rollers increases when a sheet of media is inserted in the nip. As a result, uneven fixing of toners and ink to the media occurs. Higher pressures than necessary to fix toners and ink are then required at the ends of the nip to assure adequate fixing pressure at the center of the nip.

These existing two roller systems typically require extremely high end loads. In some cases, such as for a 10 inch long roller, as much as 1,000 lbs. of force must be applied. A representative roller system is shown in U.S. Pat. No. 5,195,430 to Rise and which is assigned to the assignee of the present invention. The structural supports for these rollers are typically relatively heavy and bulky since they must be capable of withstanding extremely high forces to achieve the desired line loading along the line of contact between the rollers. Additionally, these systems use rollers of a length which equals or exceeds the width of the media to be treated. Long rollers lack compactness and typically add a significant amount of weight, as well as cost, to systems using these devices.

There are also devices in the prior art which include a pair of rollers which are skewed, that is, the longitudinal axes are supported out of parallel with one another, to compensate for the deflection of the fusing rollers. Skewing the rollers allows the ends of the rollers to wrap around each other as they deflect under load, resulting in more uniform pressure along the nip. However, skewing the rollers also results in forces which act on the media in a direction substantially perpendicular to the path the media travels. These lateral forces tend to crease or wrinkle the media during passage through the nip. Also, such an apparatus is generally limited to pressure fixing at one line loading value. For example, higher loading causes greater deflection in the rollers, which requires a greater skewing angle to avoid non-uniformity along the nip.

Other expedients have been introduced in an attempt to overcome the problem of deflection of fixing rollers upon the application of force to the ends of the rollers. Large diameter fixing rollers reduce, but do not eliminate, the deflection. However, large diameter fixing rollers add weight, cost and bulk to the apparatus. A backup roller or rollers in pressure contact with the pressure fixing and developing rollers has also been used to urge the pressure fixing rollers together along the nip. Such backup roller systems suffer from the disadvantage of requiring additional space for the backup rollers and also require additional components in comparison to a typical two roller system.

Another method suggested in the prior art is to use a roller which is crowned at the center to compensate for the deflection due to loading. However, crowned rollers have a faster surface velocity at their center than at their ends. This differential in surface velocity contributes to wrinkling of the media and limits the versatility of these devices in handling various types of substrates.

As a more specific example of the prior art, U.S. Pat. No. 4,363,862 to Giorgini discloses an apparatus for fixing toner powder images on sheet material. In Giorgini, a non-compliant pressure roller and compliant backup roller are supported with skewed longitudinal axes. The pressure roller may be of steel with an outer layer, such as of chrome, with an irregular surface comprising a plurality of randomly sized dome projections. The backup roller is described as having a sheath of a compliant material over a central core. Organic polymeric substances are mentioned as suitable for the sheath, with nylon 6/6, glass filled nylon, hard rubber and acetal resins being specifically mentioned.

U.S. Pat. No. 4,768,050 to Berry discloses a pair of pressure rollers used in conjunction with the "Mead" imaging process in which photo sensitive microcapsules are ruptured by the rollers to provide the image. A roller having a hollow shell with a central shaft is shown.

U.S. Pat. No. 4,356,764 to Haugan discloses a pair of rollers each with a central core and an outer hollow shell. Pressure transfer rollers support the shells on their respective cores.

The use of pressure fixing rollers for fusing or spreading hot-melt ink on print media is also known. Japanese Patent No. 18,351 to Moriguchi, et al. and U.S. Pat. No. 4,745,420 to Gerstenmeier are two examples of these types of devices. Another example is U.S. Pat. No. 4,889,761 to Titterington et al. which is assigned to the assignee of the present invention. Other examples of prior art image fixing apparatus including rollers are described in U.S. Pat. No. 3,293,059 to Stowell; U.S. Pat. No. 3,566,076 to Fantuzzo; U.S. Pat. No. 4,568,949 to Muranaka; and U.S. Pat. No. 4,845,519 to Fuse. The Fuse patent discloses a printer with a fixing unit mounted on a moveable carriage mounted on an endless belt to provide reciprocating motion over all of the image forming material which is comprised of dry powder toner that is initially formed on an organic photoconductor belt and then is transferred to the paper final receiving medium.

Although a number of elongated roll-type pressure developing and fixing devices are known, a need exists for an improved mechanism for fixing or developing an image on sheet media, including images defined by hot-melt or phase-change ink on the media. Where large format printing is conducted, that is printing where the image receiving medium or substrate is larger than the fusing area or apparatus, a system must be provided to successfully fuse images to large format substrates.

Another approach, which is applicable to large format printing, has utilized at least one relatively small width pressure applicator with a pressure application surface for applying pressure to print media as the print media and pressure applicator move relative to one another. The pressure applicator may take the form of one or more pressure wheels having a width of no more than about one inch. This system, as well as the other systems discussed, presents the problem, however, of lifting off or offsetting the laid down image from the image receiving substrate as the fuser wheel moves across the imaged surface, thereby destroying or damaging the printed image quality.

These problems are solved in the design of the present invention that provides an improved image fusing or fixing apparatus for fusing or fixing image forming material on print media.

SUMMARY OF THE INVENTION

It is an aspect of the present invention to provide an improved image fusing or fixing apparatus that incorporates a lubricating or oiling surface with a moving pressure applicator.

It is another aspect of the present invention to provide an improved image fusing or fixing apparatus that may be employed with large format printers where the printed image is substantially larger than the supporting apparatus for the printed substrate.

It is still another aspect of the present invention is to provide an apparatus which is capable of fusing printed phase change ink images to media of widely varying types, thicknesses and widths without wrinkling the media.

It is a feature of the present invention that the oiling roller contacts the fusing wheel as the fusing wheel moves across the printed image on the image receiving substrate to apply a coating of adhesion reducing oil to the fusing wheel to help prevent the lifting off of the printed image from the substrate during fusing.

It is another feature of the present invention that the oiling roller and the fusing wheel are mounted for relative movement to the print media to provide overlapping passes of the fusing wheel over each section of the printed image to be fused to the image receiving substrate.

It is still another feature of the present invention that the fusing wheel and oiling rollers are mounted to a support carriage for reciprocating movement back and forth across the image receiving substrate or media during the fusing operation.

It is yet another feature of the present invention that the fusing wheel and the oiling roller are moved relative to the image receiving substrate or media to provide overlapping passes of the fusing contact surface over each section of the printed image to be fused to the image receiving substrate.

It is still another feature of the present invention is to provide a compact and light weight apparatus for applying pressure to print media to fuse the image to image receiving substrate or media.

It is yet another feature of the present invention that the fusing wheel has a roughened surface with depressions or voids that help retain the adhesion reducing oil that helps prevent the lifting off or offsetting of the printed image during fusing.

It is a further feature of the present invention that the backing plate against which the image receiving medium is pressed during fusing is selectively heated to assist the fusing operation with selected media.

It is an advantage of the present invention that fusing apparatus is provided that is capable of applying the desired pressure to fuse the printed image to the media independently of the media thickness, the width of the media and the thickness of ink on the media.

It is another advantage of the present invention that a fusing apparatus is provided which minimizes the loading forces required to provide relatively high applied pressures to the print media without lifting off or offsetting the printed image from the image receiving substrate.

It is still another advantage of the present invention that a fusing apparatus is provided which is capable of fusing phase change ink images to media of widely varying types, thicknesses and widths without wrinkling the media.

These and other aspects, features and advantages are obtained by the improved fusing apparatus of the present invention which incorporates a oiling means with a fusing means to fuse or fix a printed image to an image receiving substrate by reciprocating back and forth movement across the printed image on the substrate without lifting off or damaging the printed image. The fusing means may comprise a pressure wheel rotatably mounted to a support which positions a pressure application surface of the wheel against the ink drops forming the printed image to apply pressure to the image to fuse the image to the image receiving substrate while applying a adhesion reducing medium such as an oil that prevents the image from being lifted off of or offset from the media and facilitates the fusing process.

BRIEF DESCRIPTION OF THE DRAWINGS

These and other aspects, features and advantages of the invention will become apparent upon consideration of the following detailed disclosure of the invention, especially when it is taken in conjunction with the accompanying drawings wherein.

DETAILED DESCRIPTION OF THE PREFERRED EMBODIMENT

Figure 1:
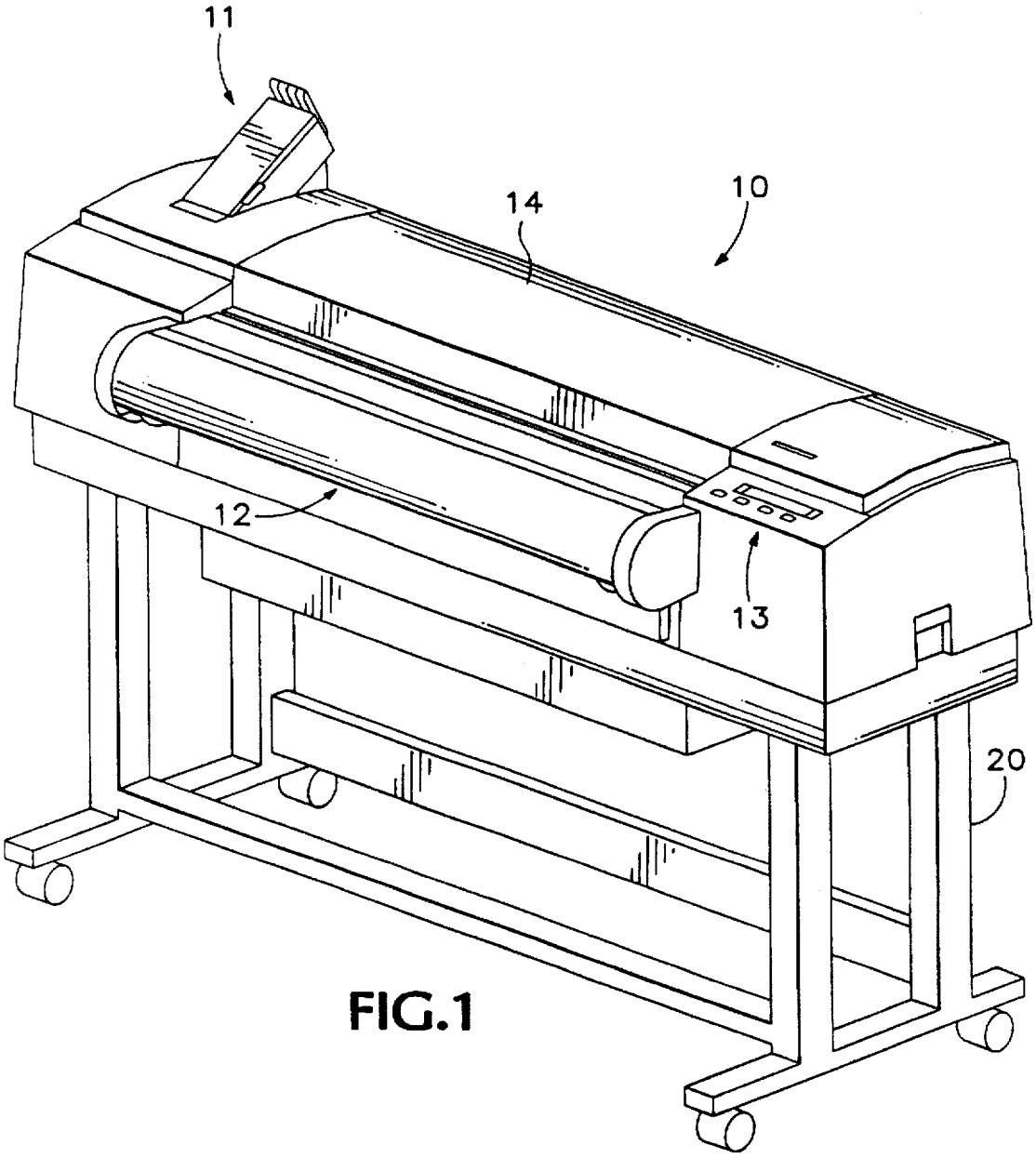
FIG. 1 is a perspective view of a wide format printer employing the fusing apparatus of the present invention.

FIG. 1 shows in perspective view a wide format solid ink printer, indicated generally by the numeral 10, having an ink stick feed assembly, indicated generally by the numeral 11, and a media feed assembly, indicated generally by the numeral 12. Printer 10 is mounted on a mobile printer stand 20 and has an access cover 14 that is pivotable to an open or raised position, best shown in FIG. 2, to provide access to the working components of the printer. A control panel is shown generally by the numeral 13.

Figure 2:
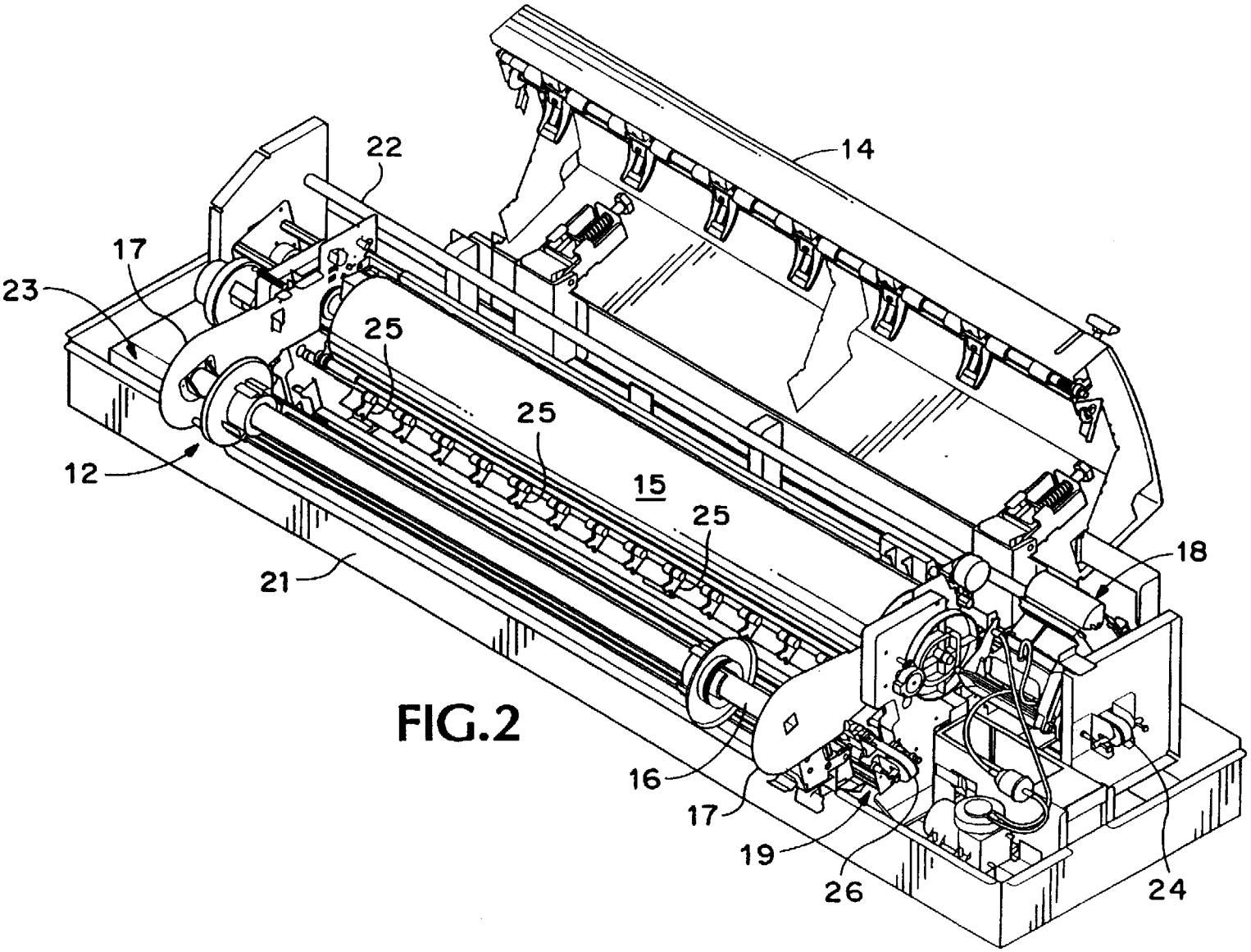
FIG. 2 is a perspective view of the operational upper portion of the wide format printer showing the fusing apparatus of the present invention positioned for reciprocal movement.

As is seen in FIG. 2, a support drum 15 provides the support surface for media by its outer periphery during the printing operation. Drum 15 can be formed of any appropriate material, but preferably is formed of a metallic material, such as aluminum, and is rubber coated. Media feed assembly 12 has a media supply spindle 16 about which is mounted the medium. The medium is normally paper, but may equally well be canvas or transparency or other plastic material such as that which is suitable for back lighting applications. Spindle 16 is appropriately mounted to opposing support plates 17 that are fastened to the printer mounting chassis 23 that sits within sheet metal pan 21.

Print head 18 is mounted for reciprocating back and forth movement along the head support shaft 22. The print head 18 is driven in reciprocating or shuttling motion past the print medium 29 (see briefly FIG. 4) as the media is drawn over the rubber coated surface of support drum 15. A steel band 24 that is rotatably driven by a motor (not shown) moves the print head 18. Once the receiving substrate or medium 29 has been imaged by the ink ejected from the print head 18, the printed medium 29 is pulled and driven around the support drum 15 and removed from the support drum by the plurality of stripper fingers 25 that span the width of the drum 15. Thus the printed image is ready for fusing by the fuser assembly 19 which is reciprocally driven back and forth by the rubber belt 26 which is driven by an appropriate motor driven pulley system, indicated generally by the numeral 28 (briefly see FIG. 4).

Figure 3:
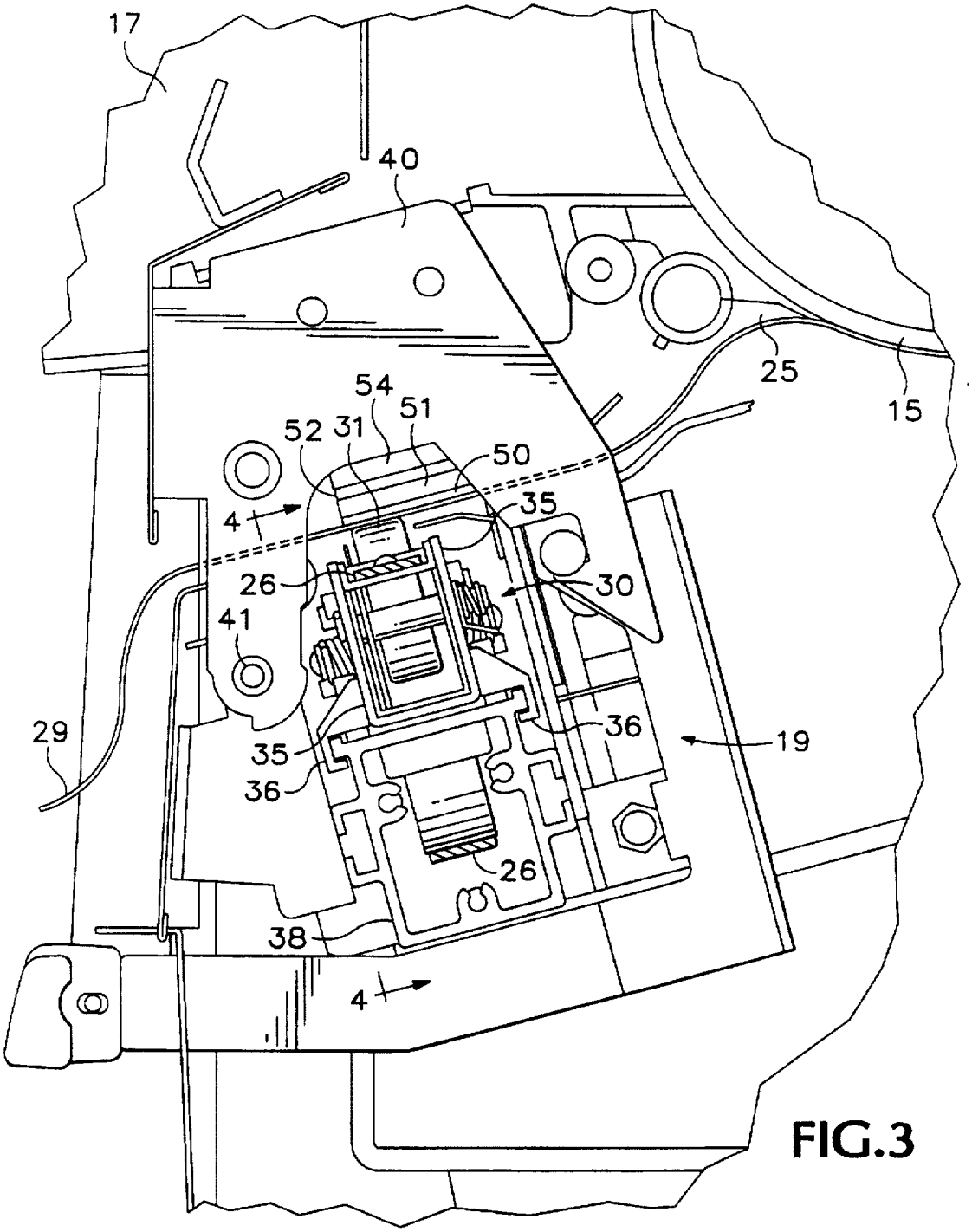
FIG. 3 is an elevational view of the fusing apparatus mounted for movement on the wide format printer.
Figure 4:
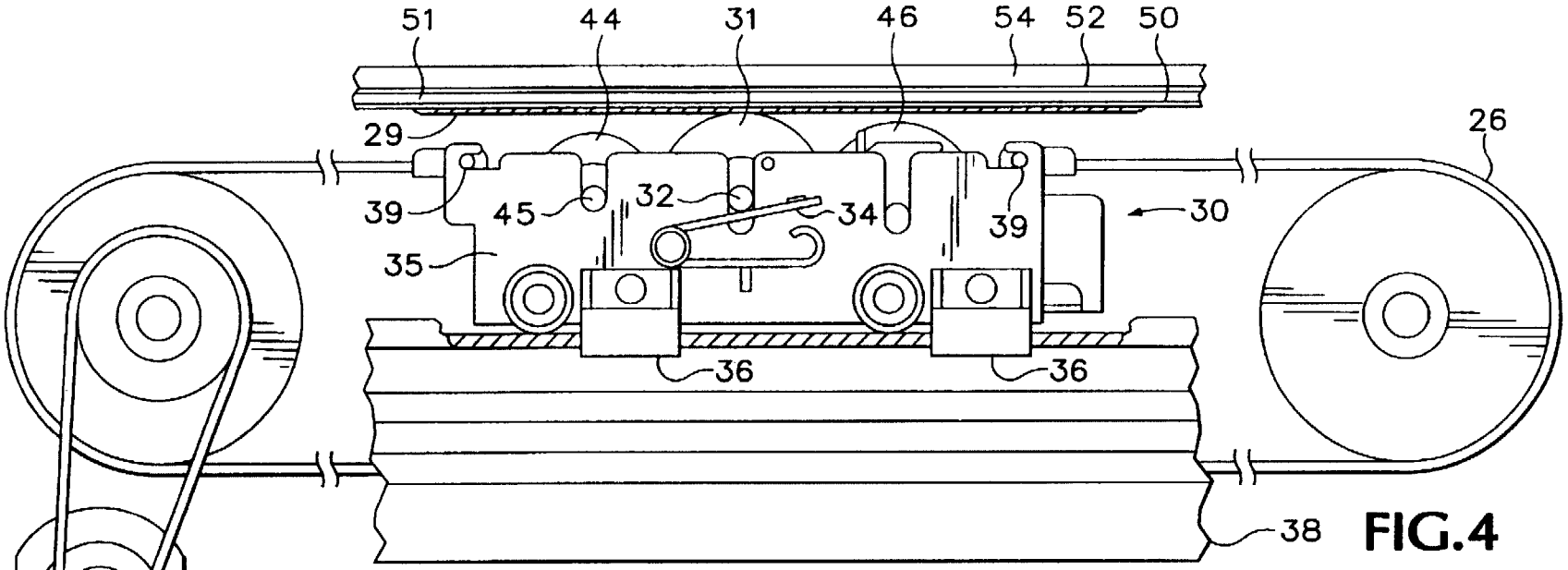
FIG. 4 is a side elevational view taken along the section line 4—4 of FIG. 3 of the fusing apparatus and its carriage showing the relative positioning of the fusing wheel, the oiling roller and a printed substrate, with a portion of the endless belt on which the carriage travels broken away.

The fuser assembly 19 includes a carriage 30 that is best seen in FIGS. 3 and 4. Mounted within carriage 30 is a fusing wheel 31 that is rotatably mounted about Shaft 32 which is removably held in place and spring loaded by spring 34. Fusing wheel 31 is removable through slots provided in opposing sides 35 of carriage 30.

The opposing sides of carriage 30 have two pair of plastic guides 36 suitably attached to the opposing sides 35, such as by screws, which guide the assembly along and about a hollow extruded aluminum track 38. The rubber belt 26, which is suitably fastened to the carriage 30 by pin and track mechanism 39 so as to permit slight relative rotational movement between the belt 26 and carriage 30, passes on its bottom run through the hollow extrusion 38 and on its upper run above extruded track 38. Access to the fuser assembly carriage 30 is obtained via a pivotable latch 40 that is hingedly fastened about pin 41 to a side support that is connected to extruded track 38 and the chassis 23.

As best seen in FIG. 4, the fuser assembly carriage 30 houses the rotatably mounted fusing wheel 31 and the rotatably mounted oiling roller or wheel 44. Oiling roller 44 is mounted about shaft 45 and is removable by merely lifting from the slot on opposing sides 35 of the carriage 30. Oiling roller 44 is preferably a foam microporous structure covered by a membranous material so that the oil is self-contained. Any appropriate composite oiling web is suitable but the preferred has been found to be that available from W. L. Gore and Associates, Inc., of Elkton, Md., as GORE™ ACU-RATE™ composite oiling web that employs a high loading of a silicone oil, such as Dow Corning 200® Fluid silicone, with a microporous structure that provides an even and highly efficient and consistent film of silicone oil. The composite web is anisotropic so that the oil wicks onto the surface of the fusing wheel 31 and does not migrate within the web. The oiling web regulates the amount of oil that is applied to the contact surface of the fusing wheel 31 that too little oil is avoided where lifting off of the printed image from the medium will occur and too much oil is not applied so that the oil does not interfere with image quality.

Carriage 30 also has mounted within it a media cutter 46 that can be used to cut the image receiving substrate at the desired length after successful completion of the imaging process by the print head 18 and the fusing of the image to the image receiving substrate or medium 29 by the fuser assembly 19.

Figure 5:
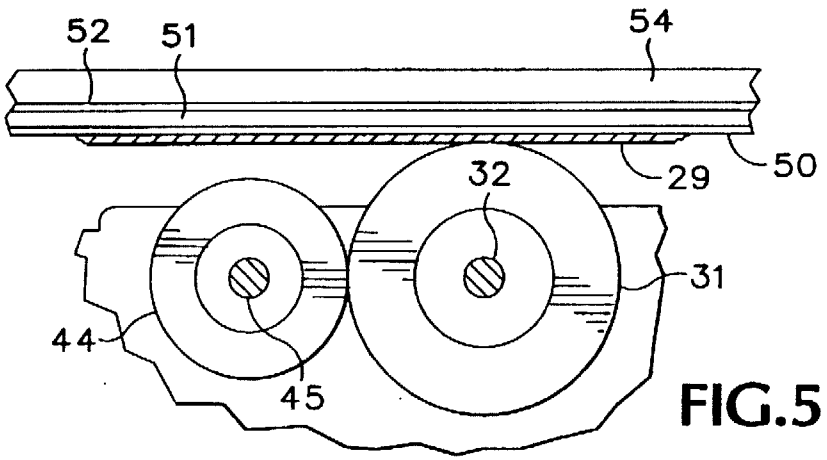
FIG. 5 is an enlarged partial side elevational view of a portion of the fusing apparatus carriage showing the relative positioning of the oiling roller and the fusing wheel mounted on the carriage with respect to a printed image on the media.

As seen in FIG. 5, the oiling roller 44 is rotatably mounted so it contacts the fusing wheel 31 as the carriage 30 moves across the imaged surface of the medium 29. The pressure contacting surface of the fusing wheel 31 applies sufficient pressure to the printed image by applying about 12.6 pounds of force to shaft 32 via springs 34 to fuse the image into the media and flatten the surface of the phase change ink while the media 29 is held in place against a backing plate 50 that is preferably hardened thin stainless steel. Adjacent backing plate 50 is an aluminum heat sink 51 that contacts a thin band of a thick film printed resistor or heater 52 that is then backed by an insulator 54 to prevent heat from building up within the printer 10. Heater 52 may be a flexible strip heater, such as that available commercially from Watlow Controls of Winona, Minn. or a fiberglass insulated flexible heater such as that available commercially from Chromalox Industrial Heating Products of Pittsburg, Pa. The heater 52 is regulated by a suitable controller which uses a temperature sensing element such as a thermistor or a thermocouple. The heating of backing plate 50 is selectively actuatable by use of a printer driver control or the printer control panel 13 of FIG. 1. When employed as a heated backing plate, the fusing temperature is between about 40° to about 60° C.

The fusing wheel 31 has a diameter that is less than 3 inches and typically is about 1 inch with a corresponding pressure application surface of about 0.38 inches width that contacts the printed image. The fusing wheel 31 may be of any suitable material but it has been found advantageous to have a textured surface that provides porosity so that silicone oil may be trapped in the voids of the surface to provide a non-adhering surface during the fusing operation. Suitable materials include aluminum 6061 that has been acid etched and anodized or TURCITE X plastic polymer by Shamban Polymer Technologies of W. S. Shamban & Company of Newberg Park, Calif. The desired surface has a measured roughness formed by voids or valleys intermediate peaks or high spots that are from about 14 to about 35 micro inches in size. A greater surface roughness than this provides peaks on the fusing wheel surface which serve as adhesion sites for ink where the ink can build up and cake on the fusing wheel 31. This hampers the fusing process by redepositing the ink on areas of the image or the media subsequently contacted by the fusing wheel 31. Fusing wheels with less than this surface roughness do not retain enough silicone oil to permit the surface to be sufficiently coated to preclude the lifting off of the solid ink printed image during the fusing operation.

Fusing wheel 31 has a slightly round or radiused contact surface to insure that contact is maintained with the printed image during the entire traversal of the fusing wheel 31 along its reciprocating path back and forth across the printed image on media sheets 29. This slightly curved contact surface, preferably having about a 32 inch radius, provides a gradual drop-off of pressure on the printed image from the centermost portion of the wheel 31 to the outer edges of the wheel and insures that some contact of the wheel is always maintained with the printed image that is held in place against the backing plate 50. The fusing wheel 31, makes multiple overlapping passes across the printed image area of the media 29 to flatten the phase change ink drops and fuse them into the media 29.

The backing plate 50 is selectively heatable by use of the heater 52 to facilitate fusing on media where such heating enhances the final image. This has been found to be especially helpful on canvas media and on selected papers when special effects are desired.

Both the fusing wheel 31 and the oiling roller 45 have a finite life and are replaceable. Opening the latch 40 covering the fuser assembly carriage 30 permits easy access to carriage 30 and easy removal of the fusing wheel 31 and the oiling roller 44. Oiling roller 44 typically lasts approximately 100 E sized sheets with the corresponding wear time for fusing wheel 31.

The activation of the fuser assembly carriage 30 and the fusing process is controlled by the printer controller which times the progress of the imaged media as it is transported along the media path about support drum 15. The drum 15 is stepped by a DC servo motor. The steps are counted so that the fusing process is timed to activate the travel of the fusing assembly carriage 30 when the imaged medium is sufficiently advanced to be in position for fusing.

In operation, the printer 10 is activated through the control panel 13. The print head 18 is filled with solid ink sticks (not shown) through the ink stick feed assembly mechanism 11 which is described in detail in co-pending U.S. patent application entitled "Solid Ink Stick Supply System" Ser. No. 08/708,766 filed Sep. 5, 1996 and assigned to the assignee of the present invention. The ink sticks are feed into the heated reservoir in the print head 18 and melted and jetted from the print head onto the media 29 as print head reciprocates back and forth across the media 29 as it is supported on the rubber coated drum 15. The media 29 is advanced about the supporting surface of support drum 15 and is stripped from the surface by the stripper fingers 25 and follow the paper path into the gap between the fuser assembly 19 and the back plate 50. Upon the printed image on the receiving substrate of the media 29 reaching the fuser assembly, the fuser assembly begins its reciprocating back and forth motion across the printed image in multiple overlapping passes pressing the contact surface of the fusing wheel 31 against the ink image on the media 29 and against the backing plate 50. Depending on the nature of the media 29, the backing plate 50 can have its resistance heater 52 activated to assist in the fusing operation. The fusing operation continues as the media 29 is advanced through the fusing station until the entire printed area has been fixedly fused to the printing media and the solid ink drops have been flattened to insure high image quality.

While the invention has been described above with references to specific embodiments thereof, it is apparent that many changes, modifications and variations in the materials, arrangements of parts and steps can be made without departing from the inventive concept disclosed herein. For example, in employing the fusing apparatus of the present invention, it is possible that the image forming material may be any type of material for forming an image on media in which the application of pressure fixes or fuses, or develops the image on the media. Micro-capsules of image forming liquids and image forming powders or toners, as well as the preferred phase-change inks, are several specific examples. Also, more than one fusing or pressure wheel may be employed in conjunction with one or more oiling rollers to apply pressure in an overlapping manner to collectively apply pressure to the entire sheet of printed media to fuse the printed image to the image receiving substrate. It is also possible where the ink jet print head of a printer is of the type which moves relative to print media during printing that a pressure applicator mount may be coupled to the ink jet print head so as to support an oiling roller and a fusing or fixing wheel so that the pressure applying fusing wheel is supported by the mount to permit it to engage deposited ink drops on the image receiving media and apply pressure to the deposited ink drops with the relative movement of the ink jet print head without lifting off any of the printed image.

Accordingly, the spirit and broad scope of the appended claims is intended to embrace all such changes, modifications and variations that may occur to one of skill in the art upon a reading of the disclosure. All patent applications, patents and other publications cited herein are incorporated by reference in their entirety.

Having thus described the invention, what is claimed is:

1. An apparatus in a printer for applying pressure to fuse a printed image on print media comprising:

pressure means mounted on the printer having a contact surface for applying pressure to the image, the contact surface having a microporous structure with a surface roughness of from about 14 to about 35 micro inches in depth;

carriage means for transporting the pressure means across the printed image which mounts and positions the pressure means against the printed image on the print media as the pressure means moves across the print media;

adhesion reducing means connected to the pressure means for applying an adhesion reducing material to the pressure means so the contact surface does not have the printed image adhere thereto as the contact surface and the pressure means move across the printed image, the adhesion reducing means being rotatable and in contact with the contact surface of the pressure means to apply the adhesion reducing material to the microporous structure in an even and consistent layer;

drive means connected to the carriage means for moving the carriage means in a path across the print media;

transport means for supporting and moving the print media along a path of travel through the printer; and support means for supporting and holding the print media in place as the media moves along the path of travel and is contacted by the pressure means to permit the printed image to be fused into the print media.

2. The apparatus according to claim 1 in which the pressure means is a fusing wheel ratably mounted to the carriage.

3. The apparatus according to claim 1 in which the adhesion reducing means is an oiling wheel and the adhesion reducing material is an oil.

4. The apparatus according to claim 2 in which the transport means is a rotatable drum that is advanced in steps and the print media is moved in combination therewith along the path of travel of the media.

5. The apparatus according to claim 2 in which the support means is an elongated backing plate that is heatable to assist in the fusing of the printed image to the print media.

6. The apparatus according to claim 2 in which the support means is an elongated backing plate tat is heatable to assist in the fusing of the printed image to the print media.

7. The apparatus according to claim 6 in which a selectively actable heater is in contact with the backing plate to heat the backing plate and the print media as the print media with the printed image thereon is contacted by the contact surface of the fusing wheel and pressure fused into the print media.

* * * * *